United States Patent [19]

Williams

[11] 4,170,116

[45] Oct. 9, 1979

[54] METHOD AND APPARATUS FOR CONVERTING THERMAL ENERGY TO MECHANICAL ENERGY

[76] Inventor: Kenneth A. Williams, 620 N. Gulf Blvd., Belleair Shores, Fla. 33535

[21] Appl. No.: 869,631

[22] Filed: Jan. 18, 1978

Related U.S. Application Data

[63] Continuation-in-part of Ser. No. 684,074, May 7, 1976, Pat. No. 4,086,772, which is a continuation-in-part of Ser. No. 618,936, Oct. 2, 1975, abandoned, which is a continuation-in-part of Ser. No. 753,921, May 2, 1975, abandoned.

[51] Int. Cl.[2] ..... F25B 13/00

[52] U.S. Cl. ..... 62/116; 62/402; 60/671

[58] Field of Search ..... 62/115, 116, 402; 60/651, 671

[56] References Cited

U.S. PATENT DOCUMENTS 3,934,424 1/1976 Goldsberry ..... 62/402

*Primary Examiner*—Allen M. Ostrager

*Attorney, Agent, or Firm*—Sixbey, Friedman & Leedom

[57] ABSTRACT

A continuous method and closed cycle system for converting thermal energy to mechanical energy comprises vaporizing means, including an energy conversion tube comprising at least one nozzle section, for converting a liquid working fluid stream to a predominantly, by volume, vapor or an all vapor stream, turbine means operated by the stream for converting a portion of the vapor stream energy to mechanical shaft work; means for increasing the thermal and potential energy of the turbine exhaust stream and for condensing it to a substantially liquid stream; and means for recycling the liquid stream to the vaporizing means. The system has particular application to conventional refrigeration/-heat pump cycles wherein the conventional throttling valve is replaced by a non-throttling nozzle and a turbine for capturing and using the work of expansion. Energy conversion tubes of the present system also find application in high flow rate, two phase flow applications, such as pressure vessel safety relief valves.

31 Claims, 7 Drawing Figures

METHOD AND APPARATUS FOR CONVERTING THERMAL ENERGY TO MECHANICAL ENERGY

This is a continuation-in-part of U.S. Application Ser. No. 684,074, filed May 7, 1976, now U.S. Pat. No. 4,086,772, which application was a continuation-in-part of U.S. Application Ser. No. 618,936, filed Oct. 2, 1975, now abandoned, which application was in turn, a continuation-in-part of U.S. Application Ser. No. 753,921, filed May 2, 1975, now abandoned.

The present invention relates to mechanical energy generating systems and, more particularly, to a method and apparatus for converting thermal energy to mechanical energy.

As is universally appreciated, the world's supply of conventional fuels, such as natural gas, oil, coal, and the like, is being rapidly consumed and the continued availability of such fuels has, in recent years, been seriously questioned. Although these fuels are utilized for many purposes in our society, perhaps no uses are more important than as a source of thermal energy convertible to mechanical energy for furnishing motive power for vehicles and boats or to electrical energy for powering our households and industries. Of course, numerous alternative energy sources are available and under development, e.g., solar energy, nuclear energy, and the like, and to the extent that these alternative sources are utilized they will partially alleviate the present and prospective fuel crisis. However, nuclear energy, for example, is expensive and its use creates monumental environmental problems which remain unresolved. Solar energy as a source of power is still in the developmental stage and, at least at present, is not totally practical for use in all climates, particularly in areas where cloud, fog or smog cover is frequent. Indeed, there is not yet available a viable alternative to the ever increasing consumption of conventional fuels to supply the power necessary to operate today's society.

There have been however, numerous suggestions for systems which more efficiently utilize energy available from conventional sources by minimizing thermodynamic and fluid dynamic losses. Unfortunately, even these systems fail to significantly improve energy conversion efficiency and, generally, omit even to make maximum use of available energy conversion opportunities. For example, U.S. Pat. No. 3,358,451 discloses a system for converting the energy of a liquid stream to power by heating a liquid working fluid to form a two-phase fluid, accelerating the fluid, separating the liquid and vapor phases, converting the kinetic energy of the liquid phase to work, condensing the vapor phase to liquid and reuniting the liquid streams prior to heating again. This system, however, neglects to extract the maximum work potential from the available energy of the working fluid and, therefore, relinquishes, rather than uses, valuable thermal energy to a heat transfer medium in a condenser.

It is therefore an object of the present invention to provide a system for producing mechanical energy which extracts more of the available work from a working fluid than has heretofore been possible.

It is another object of the present invention to provide a method for producing mechanical energy which need not consume or utilize the world's conventional fuel supply.

It is yet another object of the invention to provide an environmentally safe method for producing mechanical energy.

It is still another object of the invention to provide a method for producing mechanical energy from thermal energy where the thermal energy is derived, at least in part, from available ambient energy sources, such as the atmosphere, rivers, oceans, waste heat sources, etc.

It is another object of the invention to provide a method and system which is particularly useful in refrigeration and air conditioning applications and which substantially reduces the energy requirements for such applications.

Other objects and advantages will become apparent from the following description and appended claims, taken together with the accompanying drawings in which:

Figure 1:
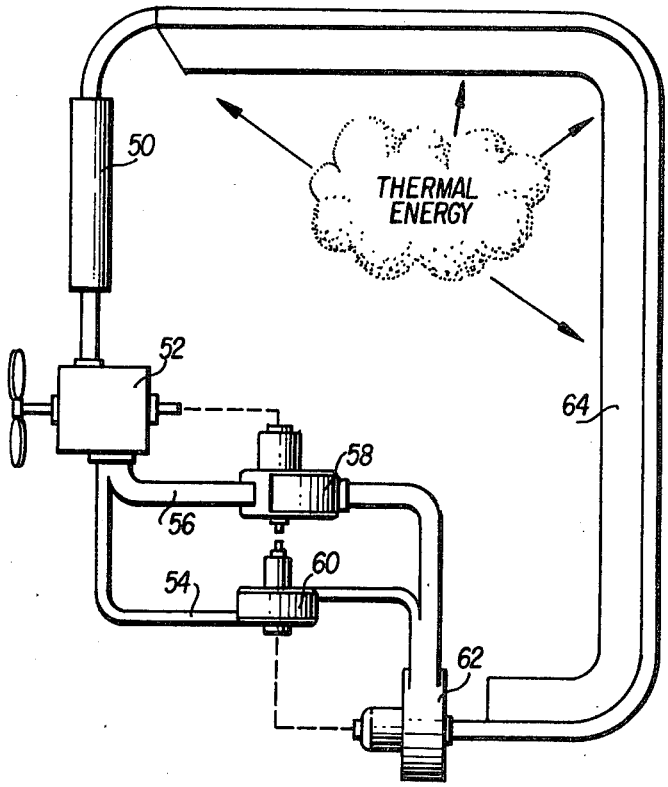
FIG. 1 illustrates, in schematic form, one embodiment of the method and system of the present invention which utilizes a single working fluid stream.

Referring to the drawings, and particularly to FIG. 1, there is shown a continuous closed cycle system for converting the energy potential of an appropriately selected pressurized working fluid into mechanical shaft energy with system energy losses, including useful shaft work, made up by drawing energy, in the form of heat, from an available thermal energy source, such as radioisotopes, nuclear reactors, combustion heat (particularly from burning of non-conventional fuel sources such as garbage), solar energy and from ambient thermal sources where available in sufficient quantity (e.g., the atmosphere, rivers, oceans, waste heat sources, etc). The system illustrated utilizes only one working fluid stream. Although there are numerous working fluids which may be used, as a general matter any liquid is suitable which is useful in an expansion work cycle taking into account the maximum and minimum temperatures and pressures of the selected cycle and the need for vaporization and condensation therebetween. For a system operating at or slightly above or below normal ambient temperatures those working fluids are most advantageous which are low boiling, and preferably those which boil substantially below the freezing point of water. Typical of these kinds of working fluids are carbon dioxide, liquid nitrogen and the fluorocarbons. Exemplary of useful fluorocarbons are difluoromonochloromethane, pentafluoromonochloroethane, difluorodichloromethane, and the mixtures and azeotropes thereof. For higher temperature, higher pressure systems the fluids may include water or other well known coolants, even including the liquid metals, e.g., sodium, potassium, mercury, and the like.

In the practice of the invention, the working fluid stream is directed to a means for converting the non-kinetic energy of a stream, e.g., its static pressure, thermal and/or potential energy, to velocity or kinetic energy, such means hereinafter referred to as an energy conversion tube (ECT), as will be more fully described. In the ECT the velocity of the stream is caused to increase while at the same time causing the static pressure and temperature of the stream to substantially decrease. As the pressure decreases, some of the thermal energy contained in the liquid is liberated and a portion of the liquid is vaporized. The resulting stream contains an increased proportion, by volume, of vapor.

In a preferred form of the invention, the energy conversion tube includes at least one nozzle section. Desirably, depending upon the system in which it is used, the ECT comprises a plurality of longitudinally spaced apart nozzle sections (see FIGS. 2 and 3) interconnected by a plurality of recovery sections. Thus, the ECT may comprise a single nozzle section alone, a nozzle and a recovery section, or a plurality of nozzle sections separated by a plurality of recovery sections. In a plural section ECT, the liquid working fluid, having high potential or static energy (high static pressure), and being substantially saturated, as defined hereinafter, enters the first nozzle section and is accelerated therein to convert it to a high velocity, relatively lower static pressure stream or jet of fluid flowing axially through the tube. The velocity of the fluid increases, as does the kinetic energy, due to the decreasing cross-sectional flow area as the fluid moves through the nozzle section. As the fluid accelerates and the static pressure thereon decreases, the saturated liquid begins to vaporize and, in so doing, consumes some of its thermal energy. The result is an increased volume, increased kinetic energy, decreased static pressure, decreased temperature and increased vapor content stream exiting the nozzle section. By "substantially saturated" as used herein, it is meant that the liquid is either saturated or so nearly saturated that under the flow conditions experienced in the first nozzle section, the liquid will vaporize at least in part. Most preferred is the condition wherein the liquid is in fact at saturation at the entrance to the first nozzle section of the ECT. It is particularly preferred that the liquid be at saturation at each nozzle section of the ECT.

The high velocity fluid stream, consisting of a relatively high velocity liquid fraction and a substantially higher velocity vapor fraction, exits the nozzle section and enters a pumping and recovery section wherein the momentum of the vapor fraction is converted to additional velocity and increased temperature and static pressure of the liquid fraction. This is accomplished by transferring a portion of the kinetic and thermal energy of the vapor fraction to the liquid fraction whereby the liquid fraction is energized or regenerated for another expansion cycle through the next nozzle section. It is believed that in the pumping and recovery section, consistent with the conservation of momentum, the relatively fast moving vapor impacts with the relatively slow moving liquid resulting in a momentum exchange between liquid and vapor and a reduction in vapor fraction velocity. The velocity reduction is accompanied by a static pressure increase (compression process) without a net expense of work causing at least a portion of the vapor to condense and to transfer its latent heat of condensation to the liquid fraction. The net effect on the motive stream working fluid is to further increase the velocity and kinetic energy of the liquid, to condense part of the vapor, to recover a portion of the static pressure which was converted to kinetic energy in the nozzle section, and to increase working fluid temperature (to a value higher than at the nozzle section exit but lower than at the nozzle section inlet) so that the increased static pressure, increased temperature liquid is ready for furher acceleration and expansion in the next nozzle section. The progressive temperature increase of the liquid through the pumping and recovery section is believed due to the vapor continuously applying its stagnation pressure to the liquid during the pumping process. This repeated vaporization-condensation sequence, occuring within the energy conversion tube, directs the work of vaporization downstream toward the low pressure area rather than more or less uniformly dissipating it in all directions. The effect is to create a pumping action upon the liquid stream with the result that a high velocity, and thus a high kinetic energy, is imparted to the liquid stream exiting the tube. It is believed that the resulting velocity and kinetic energy is greater where a plurality of nozzle sections, rather than a single nozzle section, is employed. Moreover, the use of a plurality of spaced nozzle sections permits a portion of both the latent and kinetic energy content of the vapor following initial nozzling to be transferred back to the liquid where its thermal portion is susceptible of reuse and conversion to additional kinetic energy. By contrast, for example where only a single nozzle section is used, the possibility of reusing the latent thermal energy of the vapor is reduced, necessitating the rejection of an increased amount of thermal energy to the heat transfer medium, e.g., in a condenser, rather than further using it to do additional work. This recovery and reuse of the latent heat is believed to be one important aspect of the improved performance obtainable with the system of the present invention.

Figure 2:
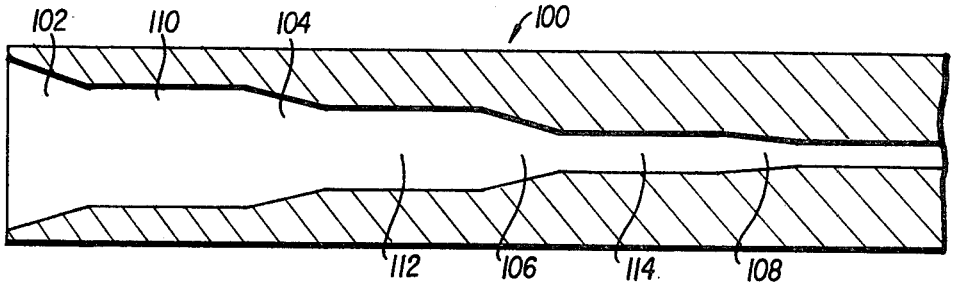
FIG. 2 illustrates an embodiment of an energy conversion tube useful in the system of the present invention.
Figure 3:
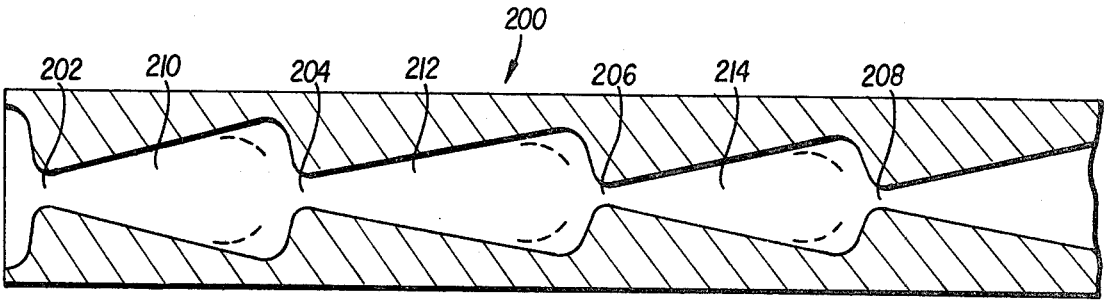
FIG. 3 illustrates a preferred form of energy conversion tube useful in the system of the present invention.

A plural nozzle energy conversion tube configured for subsonic flow conditions is shown in FIG. 2. It will be appreciated by those skilled in the art that a corresponding tube having nozzles suitably configured for supersonic flow conditions can readily be provided by those skilled in the art. Tube 100 includes a plurality of spaced apart nozzle sections 102, 104, 106, 108 interconnected by a plurality of generally cylindrical recovery sections 110, 112, 114. In the embodiment illustrated in FIG. 3, energy conversion tube 200 comprises a plurality of longitudinally diverging diffuser sections 210, 212,214. It is generally preferable to utilize diffuser sections as the recovery sections since they act as a controller, helping to prevent the static pressure front within the tube from being so low at any point that radial, rather than downstream directed, expansion of a liquid droplet occurs.

As another important aspect of the present invention, the energy conversion tube also desirably includes means for disrupting metastable flow conditions therein. Any known methods for disrupting metastable flow may suitably be used. For example, a secondary flow stream, such as a mercury stream, may be added to the working fluid stream. Alternatively, mechanical means may be used, such as interposing diverters or turning vanes in the working stream. Still other methods for disrupting metastable flow involve use of non-mechanical means, e.g., using sound or radio waves. As has already been indicated, it is important that the vaporization of the working fluid stream in a single nozzle or the vaporization-condensation sequence of the stream in a plural nozzle-recovery section ECT take place under controlled conditions such that the vaporizing action of the working fluid on experiencing reduced pressure occurs within the ECT where the thermal energy given off can be utilized by the stream and converted to kinetic energy. If the vaporization occurs outside the ECT, as might be the case if actual vaporization trails the attainment of a sufficiently reduced pressure for vaporization, then a metastable flow condition exists and the thermal energy released will not be efficiently converted to kinetic energy of the stream. Thus, continued disruption of metastable flow conditions, even in a single nozzle section ECT, is a very desirable aspect of the present invention. By disrupting metastable flow while at the same time utilizing spaced apart nozzle sections wherein the throat pressure of each nozzle section is less than the corresponding throat pressure in nozzle sections upstream thereof, the desired pumping action in the tube and increased liquid flow velocity can be most efficiently achieved. For subsonic flow conditions in the ECT, this means that the flow area of each nozzle section is smaller than the flow area of nozzle sections upstream thereof. For supersonic flow conditions, the flow area of each nozzle section is larger than the flow area of nozzle sections upstream thereof.

Referring to FIG. 1, it will be appreciated that the fluid employed can be any of the working fluids described hereinbefore. Since the system of FIG. 1 is continuous and closed, for descriptive purposes the inlet to ECT 50 has arbitrarily been selected as the system starting point. The fluid enters ECT 50 in liquid form, preferably saturated, at temperatures and pressures corresponding to an enthalpy content at least as high as the anticipated energy losses, including useful shaft work, in the system. In passing through ECT 50, which is a nozzling device such as the energy conversion tubes hereinbefore described, the potential, thermal and static energy of the fluid stream is partially converted to kinetic energy and the velocity of the stream is considerably increased while the static pressure and temperature of the stream is considerably decreased. Since kinetic energy is a function of both mass and velocity, where it is desirable to decrease flow velocity without decreasing stream kinetic energy the mass of the stream can be increased by adding a secondary flow stream, e.g., mercury. The addition of the secondary stream decreases the overall flow velocity while the mass increase keeps the kinetic energy substantially constant. The secondary stream also functions as an aid in disrupting metastable flow in the ECT. Vaporization of a portion of the liquid stream occurs within ECT 50 changing the physical nature of the stream from substantially all liquid to largely vapor, by volume.

The relatively high velocity stream exiting ECT 50 impinges directly upon the blade portion of turbine 52 to convert a portion of the kinetic stream energy to mechanical shaft energy of the turbine. If desired, an optional throttle valve (not shown) can be inserted downstream of ECT 50 and upstream of turbine 52 to control the amount of kinetic energy converted in the turbine.

The stream exiting the turbine is spent and, if the system is to be continuous and closed and the spent stream is be recycled, the energy content of the stream must be raised. This is preferably achieved in one embodiment of the invention by separating the liquid and vapor fractions of the turbine exhaust stream, increasing the static energy content of each fraction, and then recombining the fractions. One means of accomplishing the separation is by gravity separation, for example by vertically stacking the liquid and vapor fraction removal lines 54 and 56, respectively, with liquid line 54 below vapor line 56. In addition the diameter of vapor line 56 is made considerably larger (for example by a factor of 10) than the diameter of liquid line 54 to encourage the vapor-liquid separation. Vapor compressor or vapor pump 58 in line 56 and liquid pump 60 in line 54 operated by the shaft energy produced by turbine 52 increase the static pressure and energy content of the vapor and liquid fraction streams. At the same time the vapor compression in pump 58 increases the vapor temperature to a value considerably in excess of the liquid fraction temperature. The liquid and vapor streams are reunited downstream of pumps 58 and 60. The cold liquid serves as a heat sink for the vapor, for example by passing the vapor onto a thin film of the liquid in conventional fashion, causing substantially immediate vapor condensation so that the combined streams at the inlet to pump 62, which is also operated by the shaft energy produced by expansion engine 52, is substantially all liquid. Pump 62 is a liquid pump which increases the static pressure of the liquid stream to a pressure sufficient to handle, without vaporization, the thermal energy increase which the stream experiences in absorber section 64. At the same time, the pump increases the energy content of the stream.

Pumps 58, 60 and 62 also perform the necessary function of rapidly removing the turbine exhaust stream to prevent back pressure build-up at the turbine which could adversely affect its efficient operation. It will, of course, be appreciated that it is not necessary to employ a three pump arrangement as shown in FIG. 2. Instead, for example, a single centrifugal pump can be used in lieu of pumps 58–60, or indeed, any pump configuration is suitable which will perform the two basic functions of pumps 58, 60 and 62, i.e., to remove the turbine exhaust stream and increase the static head and energy level thereof.

The liquid stream leaving pump 62 is directed through an absorber section 64 wherein thermal energy is added to the system to make up for energy converted to mechanical shaft energy in the turbine 52 and for energy losses due to friction and other thermodynamic inefficiencies elsewhere in the system. The absorber section 64 should be of sufficient length or area to permit absorption of some predetermined quantity of energy and, to this end, the absorber section 64 includes control means (not shown) whereby the quantity of energy absorbed can be closely controlled. In passing through absorber section 64, the stream is re-energized to the desired extent by thermal absorption. The temperature of the stream leaving pump 62 should be considerably below the temperature of the thermal source in order that the stream may be re-energized to the desired extent by drawing upon the thermal energy available from the source. The amount of thermal energy added to the stream must be sufficient to make up for the energy converted to mechanical shaft energy in turbine 52 which is not added back into the stream in pumps 58, 60 and 62 and for energy losses due to friction and other thermodynamic inefficiencies elsewhere in the system. It will be appreciated however, that whatever the thermal source employed, thermal energy must flow from it to the system. For this reason, until the thermal source is selected and its thermal conditions are defined, an appropriate working fluid and the pressure and temperature parameters of any particular system cannot be finally selected. The stream leaving absorber section 64 is substantially saturated and has a sufficient energy content to start the cycle over again at the inlet nozzle 50. Alternatively, if desired to control the net power output, some thermal energy could be added to the fluid prior to adding the static energy thereto.

The following example is intended to illustrate one set of operating parameters for a system in which the thermal energy source is the ambient (postulated to be in the range 85°-100° F.) and in which Freon 22, commercially available from E. I. duPont de Nemours & Company, Inc., is utilized as the working fluid.

EXAMPLE

Freon, difluoromonochloromethane, was employed as the working fluid in the system illustrated in FIG. 1. The fluid energy content parameters in BTU per pound of working fluid at the indicated locations in the system as well as energy additions (+) to and energy losses (−) from the system are set forth below:

AT THE ECT INLET

AT THE ABSORBER SECTION OUTLET

Assuming the working fluid to be a liquid having no substantial velocity, all of the fluid energy is potential, i.e. static and thermal (hereinafter "PE") and none is kinetic (hereinafter "KE"):

PE=33.7 BTU/lb.

KE=0

AT THE ECT OUTLET

AT THE TURBINE INLET

PE=23.7 BTU/lb

KE=10.0 BTU/lb

AT THE TURBINE OUTLET

AT THE INLETS TO PUMPS 58 and 60

PE=27.1 BTU/lb

Work done by fluid in turbine, assuming a turbine inefficiency loss of 33%=6.6 BTU/lb

IN THE ABSORBER SECTION

Thermal energy transferred from source =+4.2 BTU/lb.

As hereinabove indicated, once thermal source temperature conditions are known and the desired turbine mechanical energy output is selected, the turbine exhaust stream temperature can be determined and from this value an approporate working fluid and minimum pressure and temperature operating parameters can be identified. In this connection, while it is appreciated that there is considerable latitude, from the standpoint of operability, in selecting temperature and pressure operating parameters, the size and cost of the system components are closely related to the operating temperatures and pressures. Thus, as a practical matter, the ultimate use of the system, e.g., for vehicle motive power wherein size may be critical or as a home power source wherein size may not be very important, may influence the physical size of the system and thereby limit the choice of operating temperature and pressure parameters.

Environmental heating and cooling is a major user of conventional energy sources and represents an area in which the present invention is particularly applicable. The most efficient conventional method of accomplishing environmental heating and cooling is via the conventional compressor powered air conditioner for cooling and its counterpart, the heat pump, for heating. It is not uncommon for such a system to deliver more than 2.5 units of heat energy for every unit of shaft power energy it uses. This cycle is essentially the reverse of the common heat/power cycle as power is its input and heat is its output. It is similar to the common heat/power cycle in that its working fluid is processed between a high and low temperature and heat energy content points ($T_1$ and $T_2$). It differs from the common heat/power cycle because in practice, the extraction of useful shaft work is omitted during the expansion of the working fluid between $T_1$ and $T_2$. In accordance with the present invention, the efficiency of the conventional refrigeration/heat pump cycle can be improved and the energy input requirements for operating the cycle reduced. In so doing the quantity of energy source material consumed will be appreciably reduced, thus reducing the overall cost to the consumer of environmental heating and cooling.

Figure 4:
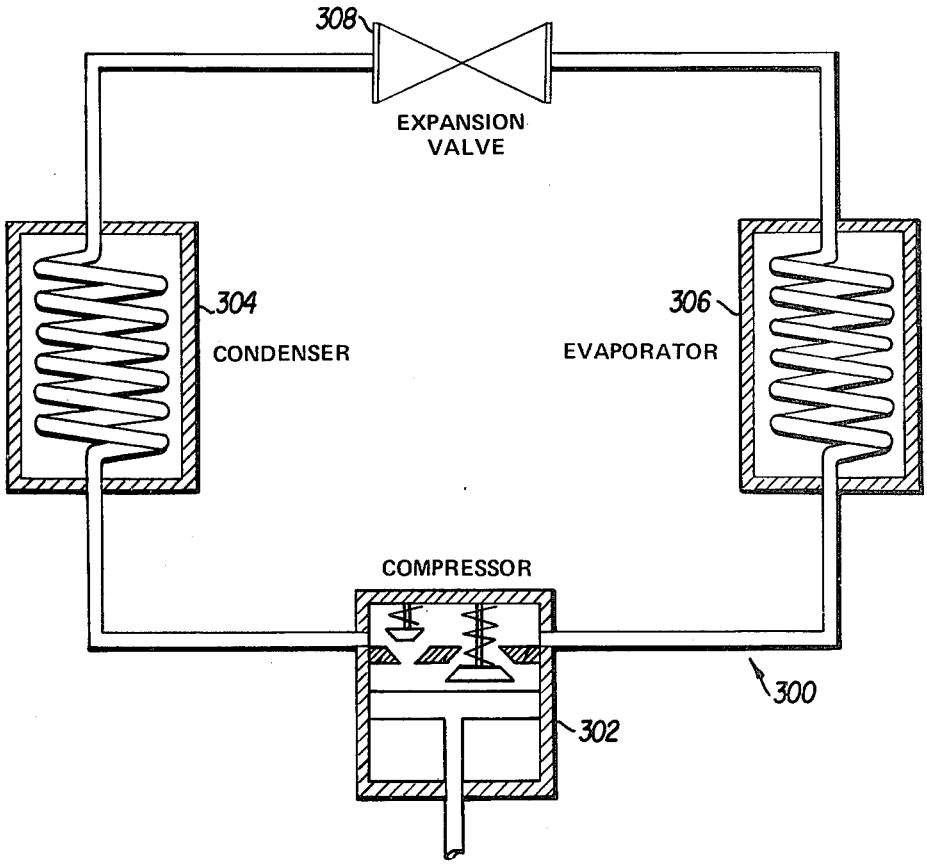
FIG. 4 illustrates, in schematic representation, the basic elements of a conventional mechanical vapor refrigeration system.

In order to appreciate the significance of the present invention in refrigeration/heat pump type applications, it will be useful to review briefly a conventional mechanical vapor refrigeration system (a discussion of its heating counterpart, the heat pump, is therefore omitted). The basic elements of such a refrigeration system 300 are shown in FIG. 4 and include a compressor 302, a condenser 304, an evaporator 306 and an expansion valve 308. A conventional refrigerant vapor at relatively low pressure is drawn into the compressor 302 to raise its pressure and temperature to a level which, taking into consideration the reasonable availability of a cooling medium, will permit heat to be rejected in the condenser 304. Generally, the compressor 302 will superheat the vapor for this purpose. In the condenser 304, the superheated vapor is cooled to a saturated or sub-cooled liquid condition by a water or air cooling medium. The saturated or sub-cooled liquid passes to the expansion valve 308 wherein it is throttled down to evaporator pressure at essentially constant enthalpy in order to reduce the saturation temperature of the liquid. Simultaneously, there occurs an unavoidable flashing of a fraction of the liquid with the result that the fluid leaving the valve is not all liquid. This flashing is, of course, an undesirable incident of the expansion since the vapor produced by the flashing has already absorbed heat and is essentially useless as a refrigerant in the evaporator. The liquid-vapor mixture may be permitted to pass directly to the evaporator 306 or, in some instances, the vapor is bled off to lessen the flow load to the evaporator. In either case, the useful refrigerant flow to the evaporator, (or space to be cooled) is a fluid at relatively low pressure. In the evaporator 306 the liquid absorbs heat from the space to be cooled and vaporizes to a saturated or superheated vapor which becomes the feed stream to the compressor 302 in the next refrigeration cycle.

Figure 5:
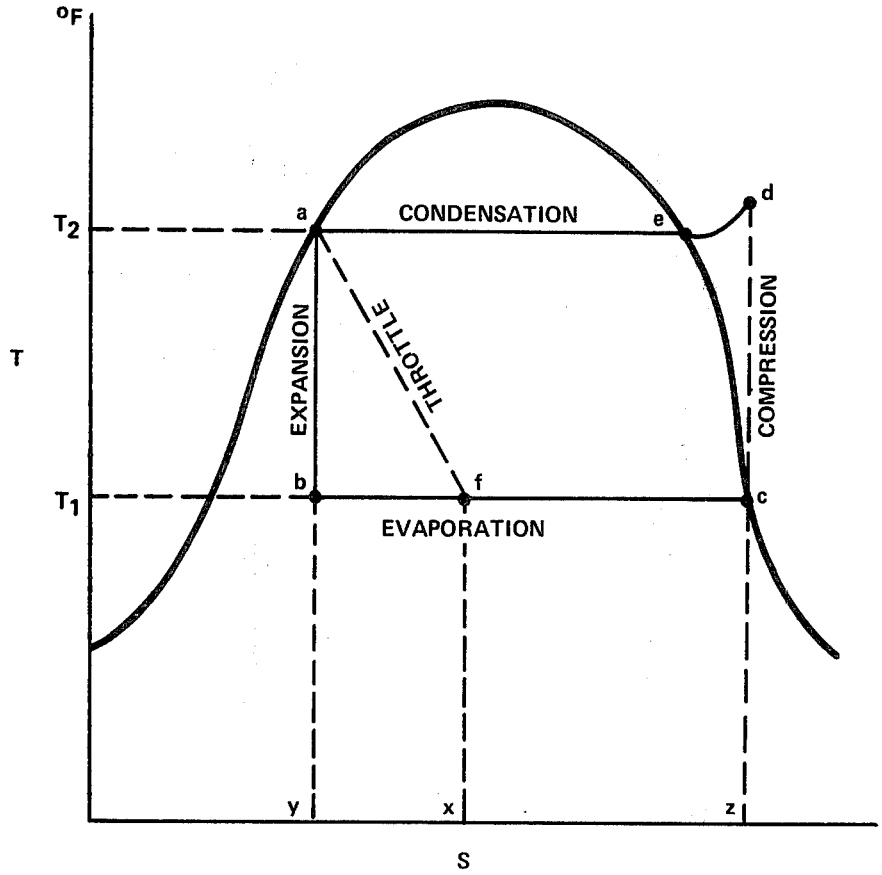
FIG. 5 illustrates, on temperature-entropy coordinates, the thermodynamic performance of the system of FIG. 4.

The thermodynamics of the basic vapor refrigeration cycle, expressed in temperature-entropy coordinates, is shown in FIG. 5 for an idealized refrigeration cycle. Although it is appreciated that the idealized refrigeration system depicted in FIG. 5 is not possible of attainment it establishes a criterion of maximum performance against which actual systems can be measured. The idealized system envisions four thermodynamic processes corresponding to the processes outlined in connection with FIG. 4. Thus, a liquid refrigerant at a undergoes an isentropic change to a liquid-vapor mixture by expanding along path ab. Heat is isothermally added to the refrigerant during evaporation along path bc during which useful refrigeration or cooling is obtained. The point c assumes a dry compression cycle, i.e., one in which the compressor suction vapor is dry or slightly superheated. The vapor is compressed isentropically along path cd to a high enough pressure to permit heat rejection in the condenser along path dea. Initially, vapor superheat along path de is rejected after which the heat of vaporization is rejected along ea. In this idealized system both heat absorption in the evaporator bc and heat rejection in the condenser dea are presumed to be constant pressure processes.

Referring to FIG. 5, it can be seen that the heat added to the system, $Q_1$, at $T_1$, which is a measure of the idealized refrigeration achieved, is represented by the area bczy. Heat is rejected at $T_2$ in an amount $Q_2$ represented by area deayz. Therefore, the net work which must be provided by an external power source, represented by area deabc, can be expressed as $$\text{Net Work} = W_N = -(Q_1 - Q_2)$$

In a conventional refrigeration system, all of this work is supplied as input power to drive the compressor.

The coefficient of performance (COP) for a refrigeration system is known to be the ratio of the refrigeration effect to the work required to produce it, or $$COP = Q_r / W_N$$

For the idealized refrigeration system, $Q_r/W_N$ can be written as $$COP = Q_1/(Q_2 - Q_1)$$

Of course, an ideal refrigeration system is not attainable in practical application and the expansion (throttling) valve neither performs external work nor actually functions without the gain or loss of heat through the pipe or valve walls. Therefore, dotted line af in FIG. 5 more realistically shows the performance of an actual throttling valve. Inasmuch as the refrigeration effect performed by the system is represented in the ideal case by area bczy and in the throttling case by area fczx, the area bfxy represents the loss of useful refrigeration in departing from the ideal.

Now, it is well known that the idealized throttling process, visualized as a constant enthalpy process, i.e., a flow process which takes place adiabatically without work production, is disadvantageous in that it foregoes the opportunity to extract from the expanding refrigerant at least some of the work that was supplied to it during compression. For example, if an expander were employed instead of a throttling valve, as has been suggested (see, e.g., Macintire et al, *Refrigeration Engineering*, 2d Ed.), and the pressure drop thereacross presumed to occur isentropically as shown in FIG. 5, a substantial fraction of the work done by the expanding fluid could theoretically be used to furnish work input to the compressor. Of course the price to be paid for the ability to recover this work is the expense of the equipment constituting the expander. Nevertheless, viewed strictly from the energy conservation standpoint, substituting an expanding engine for a throttling valve is a viable means for improving the cycle efficiency as represented by an improved coefficient of performance. This much appears to have been appreciated by many over the years, yet there seems to be no evidence that this theoretical possibility was ever developed into an efficient and economical refrigeration system.

To be sure, the use of an expanding engine or turbine has been tried in the past. See, for example, U.S. Pat. No. 1,575,819—Carrier and U.S. Pat. No. 2,519,010—Zearfoss. However, in the systems described in these patents, as in all heretofore suggested systems, the disadvantages of a throttling process are not eliminated. Instead, they merely recognize that, as a practical matter, there is a working fluid stream velocity increase which attends throttling and that by interposing a turbine in the flow path of the stream, some of the stream kinetic energy can be transferred into mechanical energy which can at least theoretically be used in the operation of the system. The result is that the useful energy having potential for doing work exiting a throttling device and delivered to the turbine is minimal, in reality 30% or less of the work potentially retrievable, and certainly below the level at which the increased capital costs attributable to the turbine could be amortized over a reasonable equipment life and be offset by any energy savings.

Figure 6:
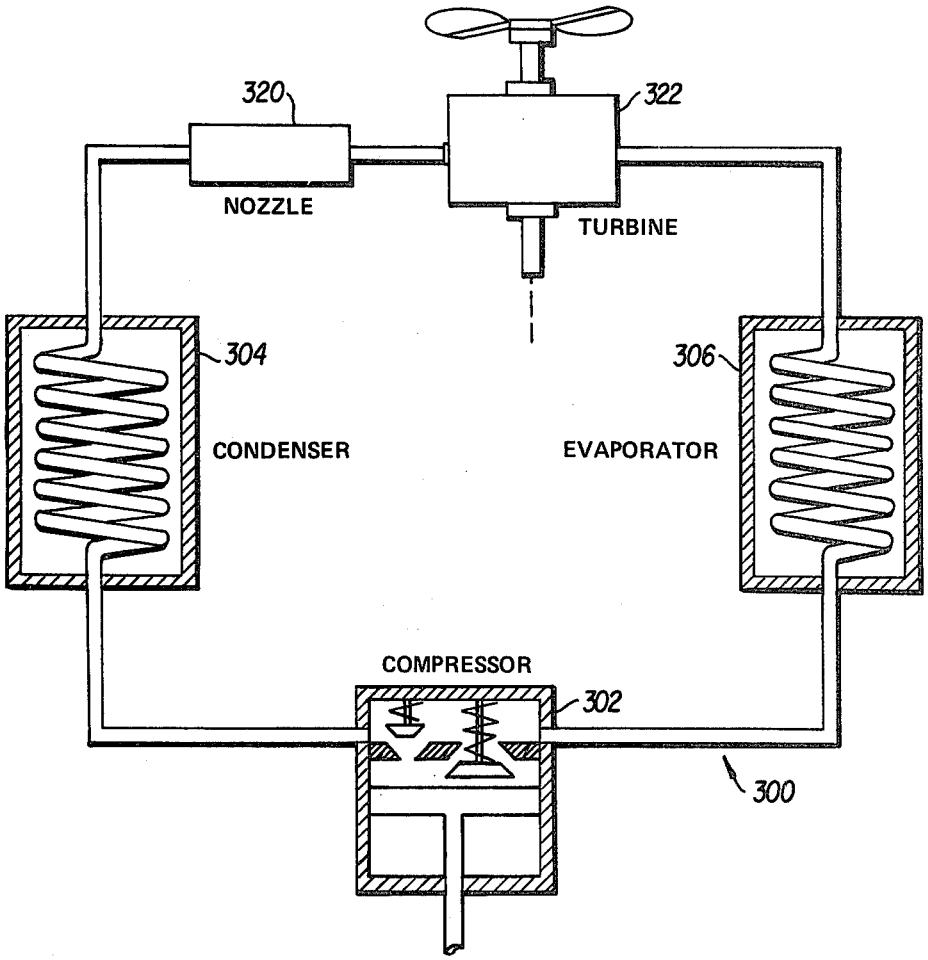
FIG. 6 illustrates, in schematic representation, the FIG. 4 system modified to include a nozzle and turbine in accordance with one aspect of the present invention.

FIG. 6 illustrates the conventional vapor refrigeration cycle modified in accordance with the present invention in which an accelerating nozzle 320 and a turbine 322 have been installed in lieu of a throttling valve. The nozzle 320 increases the kinetic energy or velocity of the fluid and impinges the fluid flow upon a properly designed turbine 322 through which the fluid expands and cools as it did in the throttling valve. This system differs from those of the prior art in its intentional omission of throttling, i.e., the omission of an adiabatic, constant enthalpy expansion in favor of an expansion which is substantially isentropic in nature or at least closely compares with the isentropic case. The expansion of a fluid through a nozzle is accomplished by continuously varying the flow area along the nozzle length and permitting the pressure and velocity of the stream to adjust. As a result, in the nozzle, the stream will exhibit a maximum velocity and minimum enthalpy at the nozzle exit. Choking can be avoided if local acoustic velocities are not achieved. By contrast, choking is normal at the exit of capillary tubes and flows restrictions result. As a consequence, for equal flow inputs and identical initial conditions, it has been found that the temperature of the two phase flow stream prior to leaving a nozzle will be lower and the velocity thereof higher than for the same stream exiting a capillary tube. Where work is removed from the fluid stream, as in a turbine, the system coefficient of performance is, therefore, increased more by a nozzle than by a capillary tube. In accordance with this embodiment, a far larger portion of the expansion work can be converted to useful shaft work which may advantageously be employed to reduce the amount of external power needed to operate the compressor, fans and pumps. Since the useful work developed by the present system is so much greater than that delivered by proposed prior art systems, the present system is believed to be economical in the sense that energy savings exceed amortized capital costs in a relatively short period of time.

Figure 7:
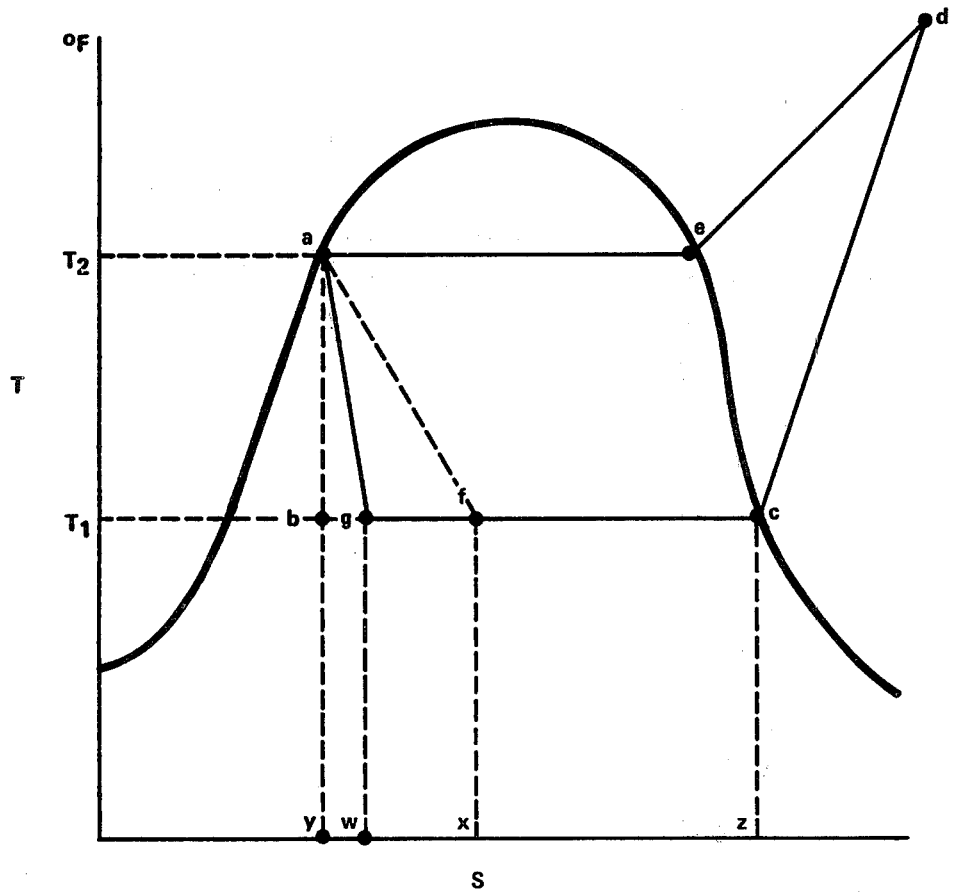
FIG. 7 illustrates, on temperature-entropy coordinates, the thermodynamic performance of the system of FIG. 6.

If the expander or turbine could actually be operated in an isentropic fashion, then dotted path ab in FIG. 7 would represent the expansion path of the refrigerant between the condenser and the evaporator. As a practical matter, however, reduced turbine efficiency and other factors make isentropic operation unrealistic and line ag is a more practical indication of the path followed during expansion through a turbine having an efficiency less than 100%. The refrigeration effect of this cycle is represented by the area gczw. Since the refrigeration effect, $Q_r$, using a nozzle and turbine is increased compared to using a throttling valve (area fczx) and inasmuch as the net work input, $W_N$, is decreased, the coefficient of performance is improved according to the expression:

$$COP = Q_r / W_N$$

In FIG. 4, the area gfxw represents the increased refrigeration effect attributable to replacing a throttling valve with a nozzle and turbine.

In a practical circumstance wherein a commercial flurocarbon refrigerant is employed in a mechanical vapor refrigeration cycle between an evaporator inlet liquid temperature of 40° F. and a condenser liquid temperature of 160° F. and assuming overall turbine and compressor efficiencies of 80%, the coefficient of performance using a throttling valve can be calculated as about COP=2.26. By comparison, where a nozzle and turbine are used in lieu of the throttling valve, the calculated COP is 3.04, which reflects an improvement of about 34%.

The failure of a throttling valve to capture and use fluid expansion work is believed to waste, at assumed equipment efficiencies of 80%, a quantity of work equivalent to about 34% of the theoretical input work needed to operate the cycle. Assuming more realistic combined nozzle-turbine efficiencies averaging about 45%, which correspond to those already experimentally attained, it is believed that about 20% of the theoretical input work to the cycle can actually be captured from the refrigerant expansion by using a nozzle/turbine configuration in lieu of a throttling valve. Applying this 20% improvement to the many billions of dollars expended annually for energy sources used in environmental heating and cooling amounts to a very substantial national savings. The savings to the ultimate energy consumer will likewise be substantial. Although the initial equipment cost for conventional mechanical vapor refrigeration/heat pump equipment modified to include a nozzle-turbine configuration in accordance with the present invention may be as much as 10% greater than present costs for conventional equipment, this additional cost would be repaid by the anticipated energy savings in less than two years.

It can, therefore, be appreciated that best results are achieved by employing a non-throttling nozzle configuration or at least one which chokes under conditions which still allow it to outperform, in terms of increased retrievable work, a capillary tube or like pressure reducing means under similar initial working fluid conditions, and by designing the nozzle and system to approximate isentropic, rather than constant enthalpy, operation. The nozzle configuration may be converging, converging-diverging, or diverging, i.e., it may generally encompass any of the configurations contemplated by the description herein. The system operating parameters generally maintain the pressure close to saturation and the working fluid is typically cycled through pressure changes which cross the fluid's saturation point. At times, the fluid may exist, for short periods, in physical states which do not correspond with the saturation conditions at the time, e.g., a liquid failing to vaporize instantaneously as pressure decreases below the saturation point. These, and other factors may cause metastable flow conditions and attendant erratic and undesirable fluid stream behavior. For example, expansion of a liquid may occur in a radial, rather than a downstream, direction or the volume produced by a phase change may reduce the effective flow area. Any such deviation in behavior from design based upon the configuration of the ECT reduces the potential for recovering work from the system and, generally, impairs the usefulness of the system for its intended function. Thus, it is particularly desirable to avoid metastable flow conditions. To this end, the use of means and methods, such as are hereinbefore described, for disrupting metastable flow are recommended for usage in connection with the ECT in this application as well.

Still another application for the present invention, although not necessarily one which is commended by its energy savings capability, is the installation of the ECT to control flow in fluid container safety relief valves. Typically, railroad tank cars transporting hazardous materials such as propane, butadiene, ammonia, ethylene, vinyl chloride, and the like utilize safety relief valves which include means for sensing over-pressure conditions in the tank and means for automatically opening to permit out-flow from the tank to a lower pressure environment, generally to the ambient. The valves are intended to open when the pressure in the closed tank car reaches a predetermined value less than the tank bursting pressure. It has been found by a study into the nature of tank car accidents that the relief valves presently in use are inadequate because they are not able to deal with the two phase flow conditions which are created when there is violent boiling within the tank following a tank car accident. The inability of tank car relief valves to efficiently handle two phase flow at high flow rates coupled with their generally inadequate sizing has created a problem of considerable proportions. In accordance with the present invention, a tank car safety relief valve including an ECT coupling the tank car and the environment to which the tank car contents is to be relieved is provided which will permit efficient relieving of large volumes of two-phase fluid streams under predictable and efficient conditions. Particularly when the ECT includes means for disrupting metastable flow therein, as has been previously described, the usefulness of the ECT in safety relief applications is enhanced. In this connection, it will be appreciated that maximum energy removal and high flow velocity and mass flow rate are among the prime objectives of such a valve. Therefore, any erratic flow stream behavior which detracts from achieving these prime objectives, such as radial rather than downstream directed expansion, or effective flow area reductions, which might result from the existence of metastable flow conditions, must be avoided in this type application even more so than, for example, in refrigeration cycle applications. It will therefore be appreciated that the configuration of the ECT is tied closely to its intended application.

While the present invention has been described with reference to particular embodiments thereof, it will be understood that numerous modifications can be made by those skilled in the art without actually departing from the scope of the invention. Accordingly, all modifications and equivalents may be resorted to which fall within the scope of the invention as claimed.

What is claimed as new is as follows:

1. In a method for achieving heating or refrigeration including the steps of compressing a refrigerant vapor stream, condensing said vapor, expanding said resulting fluid stream to reduce its saturation temperature and pressure, and passing said expanded fluid stream in heat exchange relationship with a source of thermal energy to re-vaporize at least a portion thereof, the improvement comprising:

expanding said fluid stream by passing it through at least one area of constricted flow while maintaining said flow in a substantially non-throttling condition to increase the kinetic energy thereof, and converting the kinetic energy of said resulting fluid stream to shaft work.

2. A method as claimed in claim 1, wherein said fluid stream prior to expansion is in a substantially saturated liquid state.

3. A method as claimed in claim 1, wherein said kinetic energy is converted to shaft work by passing said resulting fluid stream through an expansion engine.

4. A method as claimed in claim 1, wherein the flow through said area is disrupted to prevent metastable flow conditions therein.

5. A method as claimed in claim 4, wherein mechanical means are interposed in said fluid stream to disrupt said flow.

6. A method as claimed in claim 4, wherein wave energy is applied to said fluid stream to disrupt said flow.

7. A method as claimed in claim 4, wherein a secondary stream is added to said fluid stream to disrupt said flow.

8. A method as claimed in claim 1, wherein said fluid stream is passed through a plurality of areas of constricted flow, the static pressure of said fluid stream in each said area being lower than the static pressure of said stream in the areas upstream thereof.

9. A method as claimed in claim 8, wherein said areas are spaced apart in the flow direction.

10. A method as claimed in claim 1, wherein said fluid is passed through a plurality of flow converging areas alternating with a plurality of flow diverging areas, the static pressure of said fluid in each said converging and diverging area being lower than the static pressure of said fluid in the respective counterpart converging and diverging areas upstream thereof.

11. A method as claimed in claim 9, wherein said flow through said area is disrupted to prevent metastable flow conditions therein.

12. A method as claimed in claim 11, wherein mechanical means are interposed in said fluid stream to disrupt said flow.

13. A method as claimed in claim 11, wherein wave energy is applied to said fluid stream to disrupt said flow.

14. A method as claimed in claim 11, wherein a secondary stream is added to said fluid stream to disrupt said flow.

15. A method as claimed in claim 2, wherein said fluid stream is expanded by passing it through a plurality of areas of constricted flow, said areas being spaced apart in the flow direction; disrupting flow through said areas to prevent metastable flow conditions therein; and converting said kinetic energy to shaft work by passing said resulting fluid stream through an expansion engine.

16. In a closed cycle mechanical vapor heating or refrigeration system including compressor means for raising the temperature and pressure of a refrigerant vapor stream, condenser means for cooling said vapor stream to at least a substantially saturated liquid condition, means for expanding said liquid stream for reducing its saturation temperature and pressure, and evaporator means for passing said expanded stream in heat exchange relationship with a source of thermal energy to re-vaporize at least a portion thereof, the improvement comprising:

said means for expanding said liquid stream comprising energy conversion means including at least one substantially non-throttling nozzle section to increase the kinetic energy of said stream, and expansion engine means for converting said stream kinetic energy to shaft work.

17. A system as claimed in claim 16 wherein said nozzle section comprises an area of constricted flow.

18. A system as claimed in claim 16 including disrupting means for preventing metastable flow conditions in said energy conversion means.

19. A system as claimed in claim 18, including mechanical flow disruptors interposed in said fluid stream.

20. A system as claimed in claim 18, including means for applying wave energy to said fluid stream.

21. A system as claimed in claim 18, including means for adding a secondary flow stream to said fluid stream.

22. A system as claimed in claim 16, wherein said energy conversion means includes a plurality of spaced apart nozzle sections.

23. A system as claimed in claim 22 wherein said plurality of nozzle sections includes a plurality of areas of constricted flow spaced apart in the flow direction, each said area having a greater flow restriction than the areas upstream thereof.

24. A system as claimed in claim 22 wherein said plurality of nozzle sections includes a plurality of areas of constricted flow spaced apart in the flow direction, each said area having a lesser flow restriction than the areas upstream thereof.

25. A system as claimed in claim 16, wherein said energy conversion means includes a plurality of flow converging areas alternating with a plurality of flow diverging areas.

26. A system as claimed in claim 25, wherein said flow converging areas are nozzle sections, said flow diverging areas are difuser sections, and the first section of said energy conversion means is a nozzle section.

27. A system as claimed in claim 25, wherein said flow converging areas are diffuser sections, said flow diverging areas are nozzle sections, and the first section of said energy conversion means is a nozzle section.

28. A system as claimed in claim 22, including disrupting means for preventing metastable flow conditions in said energy conversion means.

29. A system as claimed in claim 28, including mechanical flow disruptors interposed in said fluid means.

30. A system as claimed in claim 28, including means for applying wave energy to said fluid stream.

31. A system as claimed in claim 28, including means for adding a secondary flow stream to said fluid stream.

* * * * *